US007883162B2

(12) United States Patent
Langguth et al.

(10) Patent No.: US 7,883,162 B2
(45) Date of Patent: Feb. 8, 2011

(54) DEVICE FOR INFLUENCING THE MOVEMENT OF FURNITURE PARTS WHICH CAN BE MOVED WITH RESPECT TO ONE ANOTHER, AND PIECE OF FURNITURE

(75) Inventors: Peter Langguth, Wangen (DE); Thomas Nussbaumer, Lingenau (AT); Martin Bluecher, Ehringshausen (DE)

(73) Assignees: Grass GmbH, Hochst (AT); Küster Automotive Door Systems GmbH, Ehringshausen (DE)

( * ) Notice: Subject to any disclaimer, the term of this patent is extended or adjusted under 35 U.S.C. 154(b) by 115 days.

(21) Appl. No.: 12/233,876

(22) Filed: Sep. 19, 2008

(65) Prior Publication Data

US 2009/0096337 A1 Apr. 16, 2009

Related U.S. Application Data

(63) Continuation of application No. PCT/EP2007/002509, filed on Mar. 21, 2007.

(30) Foreign Application Priority Data

Mar. 22, 2006 (DE) ..... 20 2006 004 718 U

(51) Int. Cl.
*A47B 88/04* (2006.01)

(52) U.S. Cl. ..... 312/319.5

(58) Field of Classification Search ..... 312/348.4, 312/319.5, 319.8, 319.7, 330.1, 331, 332, 312/319.1, 334.1; 318/466; 384/18, 20, 384/21, 22

See application file for complete search history.

(56) References Cited

U.S. PATENT DOCUMENTS

| | | | | |
|---|---|---|---|---|
| 6,848,761 | B2 * | 2/2005 | Salice | 312/334.4 |
| 6,913,334 | B2 * | 7/2005 | Weichelt | 312/334.4 |
| 6,945,618 | B2 * | 9/2005 | Kim et al. | 312/334.4 |
| 7,185,959 | B2 * | 3/2007 | Mueller et al. | 312/331 |
| 7,331,643 | B2 | 2/2008 | Huber et al. | |
| 2004/0100169 | A1 | 5/2004 | Huber et al. | |
| 2004/0245898 | A1 * | 12/2004 | Amann et al. | 312/334.46 |
| 2005/0231083 | A1 * | 10/2005 | Garcie, Jr. | 312/333 |
| 2007/0108931 | A1 * | 5/2007 | Bellingroth | 318/466 |
| 2008/0191591 | A1 | 8/2008 | Blucher et al. | |

FOREIGN PATENT DOCUMENTS

DE 20 2004 019 738 U1 4/2005

(Continued)

*Primary Examiner*—James O Hansen
(74) *Attorney, Agent, or Firm*—Burr & Brown

(57) ABSTRACT

The invention relates to a piece of furniture and to a device for influencing the movement of furniture parts which can be moved with respect to one another, having a guide unit for guidance of a first furniture part on a second furniture part, and having a drive unit to move the first furniture part in a driven manner relative to the second furniture part, with the guide unit having a fixed rail, which is associated with the second furniture part, and a moving rail, which is associated with the first furniture part. A pulling-pushing element is provided in order to apply a drive effect from the drive unit to the first furniture part, guided on the fixed rail via guide means.

16 Claims, 9 Drawing Sheets

FOREIGN PATENT DOCUMENTS

| | | | |
|---|---|---|---|
| DE | 20 2005 006 724 | U1 | 9/2005 |
| DE | 10 2004 045 567 | A1 | 4/2006 |
| EP | 1 374 732 | A1 | 1/2004 |
| EP | 1 557 113 | A1 | 7/2005 |
| GB | 2 398 732 | A1 | 9/2004 |
| WO | 2004/100718 | A1 | 11/2004 |
| WO | 2004/101919 | A1 | 11/2004 |

* cited by examiner

DEVICE FOR INFLUENCING THE MOVEMENT OF FURNITURE PARTS WHICH CAN BE MOVED WITH RESPECT TO ONE ANOTHER, AND PIECE OF FURNITURE

CROSS REFERENCE TO RELATED APPLICATIONS

This application is a continuation of International Application No. PCT/EP2007/002509, filed Mar. 21, 2007, which designated the United States, and claims the benefit under 35 USC §119(a)-(d) of German Application No. 20 2006 004 718.2 filed Mar. 22, 2006, the entireties of which are incorporated herein by reference.

FIELD OF THE INVENTION

The invention relates to a device for influencing the movement of furniture parts which can be moved with respect to one another, and to a piece of furniture.

BACKGROUND OF THE INVENTION

Devices are already known for influencing furniture parts which can be moved with respect to one another and can be moved, in a driven manner, relative to one another with the aid of a guide unit and with respect to one another by means of a drive unit. By way of example, toothed belts which revolve between two toothed wheels which are spaced from one another are used to transmit a drive effect from the drive unit to the furniture part to be moved, for example a drawer, in which case one of the toothed wheels can be driven.

An arrangement such as this requires a comparatively large amount of physical space, is relatively complex to produce and, furthermore, requires intensive maintenance and is susceptible to defects.

SUMMARY OF THE INVENTION

The object of the present invention is to provide a device for the movement of furniture parts which can be moved relative to one another, and to provide a piece of furniture having a device such as this, in particular with the aim of the device having a particularly compact design and being simple to install, and making it simple to compensate for the discrepancies which occur from an ideal installation situation for the device.

First of all, the invention is based on a device for influencing the movement of furniture parts which can be moved with respect to one another, having a guide unit for guidance of a first furniture part on a second furniture part, and having a drive unit by means of which the first furniture part can be moved, in a driven manner, relative to the second furniture part. The guide unit has a fixed rail, which is associated with the second furniture part, and a moving rail, which is associated with the first furniture part. One major aspect of the invention is that a pulling-pushing element is provided in order to apply a drive effect from the drive unit to the first furniture part, guided on the fixed rail via guide means. A pulling-pushing element which can be moved by the drive unit makes it possible to produce a device for influencing the movement of furniture parts which can be moved relative to one another, for the driven movement of at least one furniture part, in a comparatively very compact and space-saving manner. In particular, the pulling-pushing element results in a simple transmission means, which operates particularly reliably, for a to-and-fro movement. Furthermore, virtually all movement patterns of furniture parts which can be moved relative to one another can advantageously be carried out by a to-and-fro movement of a transmission element. In this case, it is particularly advantageous that a pulling-pushing element can transmit both relatively very high pushing and pulling forces, even over considerable distances, translationally and in the direction of its longitudinal extent. If required, the pulling-pushing element may be flexible or bendable, at least over sub-sections. This may be advantageous with respect to spatial orientations which have to be set up differently and/or for transmission of the drive effect in different directions, and for the necessary space requirement for the pulling-pushing element. In particular, the comparatively slimline pulling-pushing element makes it possible to dispense with complex devices for switching and/or deflection of the transmission means.

The guide means allow the guidance for the pulling-pushing element to be designed to be comparatively simple and space-saving, advantageously making use of the fixed rail which is provided in any case. This is advantageous with regard to the device for influencing movement being designed to be as lightweight and slim as possible. In addition, this means that there is no need to modify the moving rail for the guidance of the pulling-pushing element. At the end, the pulling-pushing element is firmly fitted to the position member, by means of the part which projects out of the guide. The pulling-pushing element is thus accommodated in the guide on the fixed rail, and therefore most of the time in a space-saving manner, when the movable furniture part is in the closed or moved-in position. In principle, guide means can also be provided for guidance of the pulling-pushing element on the moving rail.

Furthermore, when using a pulling-pushing element, it is particularly advantageously possible to achieve relatively low friction losses between the moving pulling-pushing element and adjacent sections. This makes it possible to produce an apparatus for influencing movement which is subject to particularly little wear, requires particularly little maintenance, or is maintenance-free. The device for influencing movement is accordingly distinguished by reliability and robustness which are high overall. This advantageously makes it possible to achieve a large number of load cycles without material failure, and to ensure that the device has a long expected life.

In addition, the movement can be transmitted to the furniture part to be moved by means of a pulling-pushing element according to the invention with comparatively few parts, which reduces cost.

A cable-like part or a partially flexible part has been found to be particularly advantageous for the pulling-pushing element. This is advantageously designed completely identically, or is designed to have different flexibility or to be stiff in subsections. For example, in a subsection which is deflected in order to apply the drive effect, for example, a pulling-pushing element may be flexible or bendable to a certain extent, while it may be virtually stiff or rigid, for example in the form of a pushing-pulling rod, in another subsection. Various plastics may also be used as the material for the pulling-pushing element, in addition to metallic cables or wire meshes, or metal rods.

In order to transmit force and movement from the drive unit, and/or a transmission unit, to the pulling-pushing element, the latter may be provided, for example, with a matching shape and/or contour, for example with a profiled outside, via which the necessary forces can be transmitted from the drive unit to the pulling-pushing element, moving the latter to and fro. By way of example, the pulling-pushing element may advantageously be provided with helical or thread-like out-sides, which make an engaging contact with corresponding mating sections of a drive or transmission part, in order to transmit force. The drive effect is therefore transmitted in particular in a very confined space and without additional parts. In addition to the simple drive, this also elegantly allows switching between two opposite movement directions of the pulling-pushing element in its longitudinal alignment. For example, a rising cable with an additional pushrod or without a pushrod connected to it in the longitudinal direction can be provided as the pulling-pushing element.

A further major aspect of the invention is that adjusting means are provided for adjustment of the position of a position member on the moving rail, on which position member the pulling-pushing element acts in order to apply the drive effect to the first furniture part. The first furniture part, which is to be moved by the pulling-pushing element, can particularly advantageously be achieved by a drivable movement of the moving rail. Since the moving rail is generally produced separately and is fitted as a separate unit to the complete first furniture part, the movement transmission can be set up independently of the nature and/or the presence of the first furniture part, or of the drawer, on the moving rail. This can be particularly advantageous when using standardized moving rails, which are used for different furniture models. The absolute position of the movable furniture part relative to the second or stationary furniture part is therefore also determined by the position member, via the pulling-pushing element. The capability to adjust the position member can be used, in particular in the case of a completely assembled guide unit and/or of the furniture parts which interact with it, to provide fine adjustment in this state in order to achieve exact alignment and/or a separation position and/or angle position of the furniture parts with respect to one another, preferably when the movable furniture part is in defined stationary positions, for example in the completely open or completely closed position. This is because, particularly as a result of discrepancies in the actual installation positions from ideal installation positions, fine adjustment of the prefitted movable furniture part with respect to the furniture part which is fixed with respect to it and the position of the movable furniture part in relation to adjacent furniture parts or objects is particularly helpful. Particularly, for example, when the movable furniture part is in a stationary state which, for example, the drive unit defines as a closed position, it is desirable to adjust the position at which the pulling-pushing element acts, since the movable furniture part is located in this position most of the time and, for example, alignment errors in the closed position are visually particularly conspicuous and are considered to have a particularly negative effect. In this case, during movement of the movable furniture part, fine adjustment is possible via at least two points of action, for example by means of two pulling-pushing elements, thus in particular allowing mechanical matching for example of a left-hand and right-hand drawer guide independently of one another, for example for parallel alignment of a drawer front with respect to a furniture housing edge.

The adjustment of the position member on the moving rail also makes it possible at any time to compensate for any minor position shifts which may occur of the relevant parts during operation, which can lead to a position error of the movable furniture part.

For example, a corresponding furniture front, which comprises a plurality of drawers which are positioned one above the other and/or at the side of one another, and which must be aligned exactly with respect to one another in their closed final position, can be created in an uncomplicated form by means of the proposed position member and the pulling-pushing element which acts on it.

The adjusting means are preferably designed such that the adjustment is carried out by movement of the position member parallel to the longitudinal direction of the pulling-pushing element. For this purpose, the pulling-pushing element just has to be set back or set forward by means of the position member in its longitudinal direction in order to allow the adjustment of the position of the position member, and therefore of the position of the first furniture part relative to adjacent objects. This can be achieved without any further measures, since the pulling-pushing element can be moved or shifted in its longitudinal direction in any case, and can compensate for minor separations at any time.

In principle, in an alternative or additional variant, the adjustment or depth adjustment of a drawer front in a furniture housing is also possible within the pulling-pushing element, for example at the coupling point between a rising cable and a pushrod which is connected to it directly or via an intermediate element.

In one preferred refinement of the device according to the invention, the adjusting means are designed such that adjustment is possible when the guide unit is in the state in which it is mounted ready for use on the furniture parts. This allows readjustment or fine adjustment of the position member, and therefore of the movable furniture part, in particular after initial fitting has been carried out. This may also be advantageous for movable furniture parts which are operated frequently. Minor position shifts which may occur as a result of the frequent movement of the first furniture part can thus be compensated for. In particular, the adjusting means are positioned such that they are easily accessible and can be operated easily, for example from an operating face of the movable first furniture part.

The adjusting means are advantageously designed for continuously variable adjustment of the position member. This makes it possible to achieve even very small adjustment movements of the position member, for example in the region of fractions of a millimeter or of a few millimeters. This may be particularly advantageous for large-area front parts of the movable furniture part where even very minor discrepancies from an ideal position with respect to adjacent furniture parts or housing edges can be visually perceived by the human eye, and are found to be annoying.

In a further advantageous refinement of the subject matter of the invention, the adjusting means are formed on an end section, viewed in the longitudinal direction, of the moving rail. By way of example, a front end section of the moving rail, which is accommodated in a furniture housing, may just need to be moved relatively slightly from the closed position in order to allow access to the front part of the moving rail or to allow the adjusting means to be operated.

In this case, according to the invention, it is particular advantageous that the transmission of the drive effect to the movable furniture part does not require any direct connection to the movable furniture part itself, but is achieved by the driven movement of the moving rail. This therefore allows the drawer to be removed from the guide unit, in particular without the use of any tools, and to be fitted again later without any problems, in order to allow the adjusting means to be operated better. In this case, the installed guide unit can remain completely in its installed state.

The position member advantageously comprises an adjusting slide which is held, such that it can move, on a guide part. The adjusting slide can therefore be accommodated in a protected manner and, for example, can be moved in fine steps or continuously variably, or can be moved such that it can be shifted with comparatively small forces, via guide sections, which are matched to one another, on the guide part and on the adjusting slide.

In one preferred embodiment of the device for influencing movement, the adjusting means are fitted as a separate unit to the moving rail. This allows this unit to be replaced, assembled and disassembled again without any problems, as is particularly desirable for maintenance and initial installation purposes. The adjusting means can be fitted directly to the moving rail, or can be connected indirectly to the moving rail via an intermediate piece.

It is also proposed that the guide part can be fitted to the moving rail via a detachable securing means. This allows the position member to be fitted to and removed from the moving rail quickly. The guide part is advantageously fitted to a particularly easily accessible part of the moving rail, for example to a front or rear end of the moving rail.

In a further advantageous refinement of the subject matter of the invention, the adjusting slide has a threaded section with which a matching opposing thread on a control part can interact in order to adjust the adjusting slide. The adjusting slide can be adjusted in finely graduated steps by means of a threaded section and a matching opposing thread. For example, the control part can be provided with an external thread which can engage in an internally threaded section of a depression in the adjusting slide. For example, a screw with a head which is fixed in its longitudinal direction in the position member can be used as a control part, and can be screwed into and out of a cylindrical internal thread in the adjusting slide. The adjusting slide can therefore be moved forwards or backwards, depending on the rotation direction, by rotation of the screw with a head.

It is also proposed that the guide means for guidance of the pulling-pushing element comprise a part which can be detachably plugged onto the fixed rail. This allows the fixed rail to be installed and assembled in a modular form conveniently. This may be advantageous, for example, when standardized base bodies are used for fixed rails on which guide means can be selectively fitted for guidance of the pulling-pushing element. Alternatively, the part can also be removably fitted to the fixed rail by being clipped on, pushed on or pivoted in.

The guide means advantageously comprise a slotted guide profile, in particular a hollow profile which is slotted in the longitudinal direction. This makes it possible to achieve an arrangement which is particularly space-saving and comprises relatively few parts. In this case, by way of example, the pulling-pushing element may be in the form of a flexible rising cable, in particular without a pushrod, which acts via a driver element, which is provided on the moving rail, thereon. This pulling-pushing element can thus, for example, be connected to a rear end of a drawer rail. The guide profile is designed to be slotted, in order to drive the pulling-pushing element which can be moved to and fro in the guide profile.

In addition, the invention covers a device for influencing the movement of furniture parts which can be moved with respect to one another, having a guide unit for guidance of a first furniture part on a second furniture part, and having a drive unit by means of which the first furniture part can be moved, in a driven manner, relative to the second furniture part, with the guide unit having a fixed rail, which is associated with the second furniture part, and a moving rail, which is associated with the first furniture part. One major aspect of the invention is that a part which can be detachably plugged onto the fixed rail has holding areas for line means. This advantageously makes it possible to achieve additional functions on the part which can be plugged on. For example, connecting lines for electrical additional elements can be accommodated in the part which can be plugged on, for example electrical supply lines for lighting elements or other electrical devices in the furniture part. The part can also be fitted by being clipped on, pushed on or pivoted in.

The invention also relates to a device for influencing the movement of furniture parts which can be moved with respect to one another, having a guide unit for guidance of a first furniture part on a second furniture part, by means of which guide unit the first furniture part can be moved relative to the second furniture part, with the guide unit having a fixed rail, which is associated with the second furniture part, and a moving rail, which is associated with the first furniture part. One fundamental idea of the invention comprises a part which can be detachably fitted to the fixed rail in order to accommodate line means. This also allows precautions to be taken for the device to be fitted with line means quickly and selectively, for the abovementioned devices as well.

The invention is also based on a piece of furniture having a first furniture part which can be moved relative to a second furniture part, in particular having a drawer which can be moved in a housing, in a driven manner, via a drive unit, with a guide unit being provided for guidance of the first furniture part on the second furniture part. In this case, the furniture part has one of the abovementioned devices according to the invention, thus making it possible to achieve the described advantages on the piece of furniture.

BRIEF DESCRIPTION OF THE DRAWINGS

Further features and advantages of the invention are illustrated, using various exemplary embodiments, in the figures of the drawings.

DETAILED DESCRIPTION OF THE INVENTION

Figure 1:
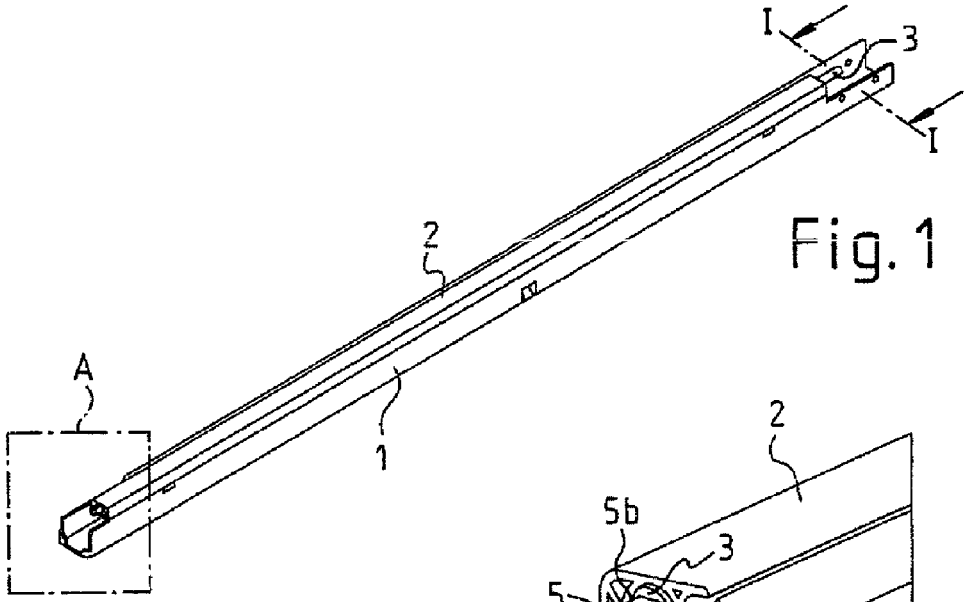
FIG. 1 shows a perspective view obliquely from above of a basic profile of a housing rail of a drawer guide with a guide profile with a pulling-pushing element guided in it.

FIG. 1 shows a base-rail part 1, which comprises a bent-around sheet-metal section, for a housing rail, which is known per se, of a drawer guide. A drawer guide such as this comprises, in particular, a right-hand and a left-hand drawer guide unit, each having a drawer rail which is attached to a drawer and having a housing rail which is firmly fitted to a housing, possibly with a center rail arranged in between.

Figure 2:
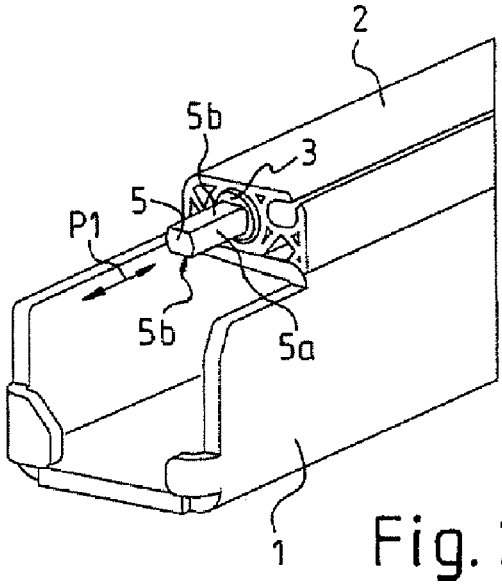
FIG. 2 shows an enlarged detailed view from FIG. 1, showing the detail A.

When the base-rail part 1 is in the installed position, a guide profile 2 is fitted to it at the top, in which a movement rod 3 of a pulling-pushing element is accommodated. This movement rod 3 may, for example, be a push rod composed of a cylindrical hollow material, in particular composed of metal or plastic. The movement rod 3 is held in a cylindrical elongated hole 4 such that it can move in the longitudinal direction of the movement rod 3 or translationally, or is guided in the form of a journal bearing. A comparatively narrow separating gap can be provided for this purpose between the outside of the movement rod 3 and the elongated hole 4. The movement rod 3 can be moved axially to and fro, as indicated by the arrow P1 in FIG. 2, in the elongated hole 4, in particular with comparatively very little friction.

Figure 3:
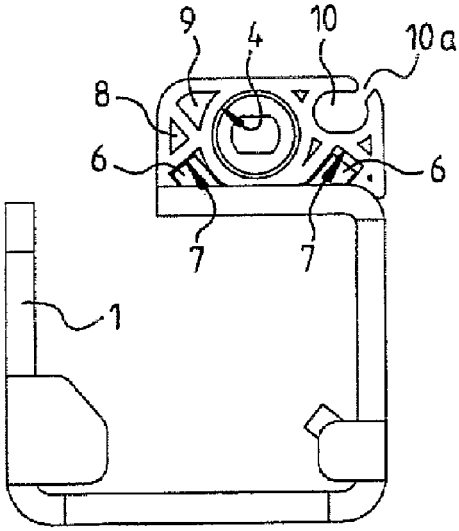
FIG. 3 shows a front view of the front end of the arrangement shown in FIG. 1.

The front end section of the movement rod 3 has a pin 5 whose external diameter is less than that of the movement rod 3 and which has a plug-in contour. In this case, by way of example, two opposite rounded outer surfaces 5*a* and, between them, two opposite plane-parallel, flattened outer surfaces 5*b*. As shown in particular in FIGS. 2 to 4, the guide profile 2 is in the form of a structure body which is provided with cavities in places and can be detachably fitted, for example, to the base-rail part 1, for example by being plugged on, clipped on, pushed on or pivoted in. For this purpose, by way of example, sheet-metal lugs 6 which are bent upwards on the upper face of the base-rail part 1 can engage in grooves 7, appropriately matched to them, on the lower face of the guide profile 2, to provide firm clamping. The sheet-metal lugs 6 may, for example, be in the form of slotted sheet-metal flaps composed of the sheet-metal material of the base-rail part 1. The number, shape and distribution of the sheet-metal lugs 6 over the length of the base-rail part 1 may be as required, and, for example, they can be arranged offset with respect to one another or may be chosen such that the width of the sheet-metal lugs is different. The sheet-metal lugs 6 in the base-rail part 1 are advantageously designed such that the base-rail part 1 is not significantly mechanically weakened and there is no disadvantageous influence on the movement of a carriage on rollers running on the base-rail part 1. By way of example, the guide profile 2 may be pushed onto the base-rail part 1 from the front or rear, with the walls of the grooves 7 clasping the sheet-metal lugs 6, partially resting on them, so as to allow secure and firm positioning of the guide profile 2 on the base-rail part 1. As is shown in FIG. 1, the guide profile 2 may be formed over the entire length of the base-rail part 1, but may also be provided thereon just in places, and possibly in more parts.

In addition, further closed or open cavities, for example 8, 9 and 10, are formed in the interior of the guide profile 2, and additional elements can be accommodated in them. By way of example, the cavity 10 can be used to accommodate a supply cable for a light source and, for this purpose, is in the form of a profile, which is open at the front and rear, and/or is provided with a slot 10*a* over its length. The cavities, for example 8 and 10, allow the guide profile 2 to be formed with the aid of appropriate strut structures such that on the one hand it is comparatively robust, while on the other hand it is designed to be relatively lightweight.

Figure 4:
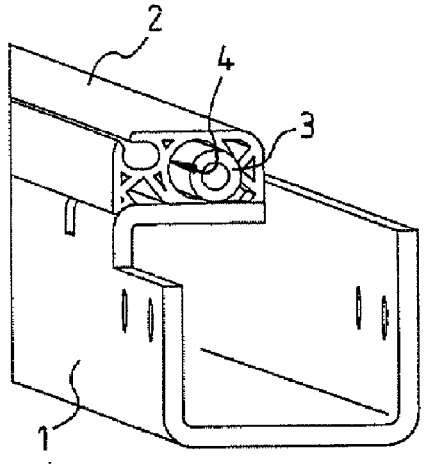
FIG. 4 shows a perspective view of a section transversely with respect to the longitudinal extent of the arrangement shown in FIG. 1, along the line I-I in FIG. 1.

By way of example, FIG. 4 shows the movement rod 3 in the form of a hollow cylinder. The movement rod may, however, also have a different shape or else may be composed of solid material.

Figure 5:
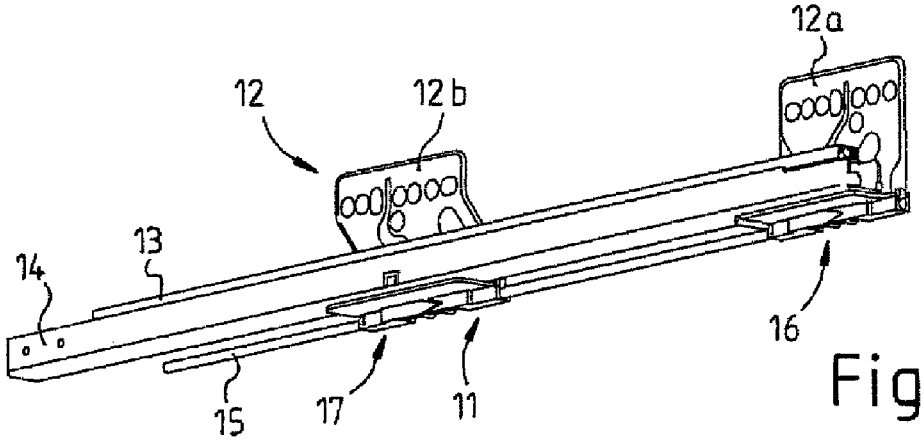
FIG. 5 shows a perspective view of a housing rail of a drawer guide with guide devices fitted to it, for guidance of a pulling-pushing element, and a supply line.

FIG. 5 shows a further embodiment of a guide profile 11 according to the invention on a housing rail 12. The housing rail 12 also comprises a further guide profile 13 which is designed in a corresponding manner to the guide profile 2 shown in FIGS. 1 to 4. In order to fit the housing rail 12 to a housing, fitting jaws 12*a*, 12*b*, which are in the form of sheet-metal brackets, are attached to a lower face of a base-rail part 14. The guide profile 11 essentially comprises a guide tube 15 in which, for example, a pulling-pushing element can be guided such that it can move, and other elements can be accommodated if required. In this case, by way of example, two adaptor elements 16, 17 are plugged onto the fitting jaws 12*a*, 12*b* for attachment, support and guidance of the guide tube on the housing rail 12. In principle, just one adaptor element or else even more adaptor elements can also be fitted to the housing rail 12.

Figure 6:
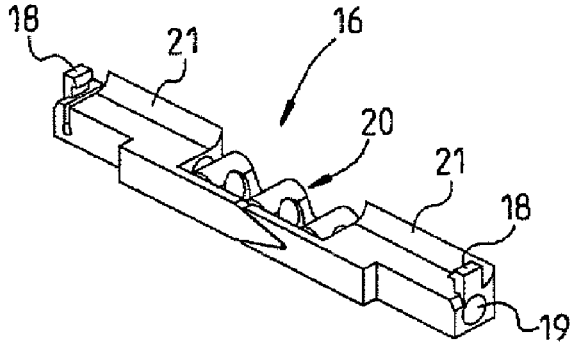
FIG. 6 shows a perspective view of a part of one of the guide devices shown in FIG. 5.

FIG. 6 shows a perspective view of the adaptor element 16, which is designed to be identical to the adaptor part 17. The adaptor element 16 can be plugged from below onto a bent-around sheet-metal limb of the fitting jaws 12*a*, 12*b*, by means of two latching tabs 18 which are fitted to the adaptor element 16 at the end. In this case, the latching tabs 18 spring slightly open and, after clasping the sheet-metal limbs, snap into a fixed latching position on the fitting jaws 12*a*, 12*b*. The adaptor element 16 is plugged onto the fitting jaw 12*a* in an area of the sheet-metal limb of the fitting jaw 12*a* which is formed at the side on the base-rail part 14 as far as a bend of the fitting jaw 12*a*, between the sheet-metal limbs which are angled away from one another.

The adaptor element also has a guide channel 19 in which the inserted part of the guide tube 15 is accommodated, and/or the adaptor element 16 also has a spring section 20, which is formed approximately centrally and, in particular, allows length compensation of the adaptor element 16 in its longitudinal direction. The spring section 20 is used to match the length of the adaptor element 16 to the respective width of the sheet-metal limb of the fitting jaw onto which the adaptor element 16 is plugged. This advantageously makes it possible to achieve fitting jaw dimensions which are used differently, with an adaptor element of identical design. A contact edge 21 is provided for secure positioning of the adaptor element 16 in the bent-around area of the fitting jaw 12*a*, and rests on the bend on the fitting jaw 12*a*.

Figure 7:
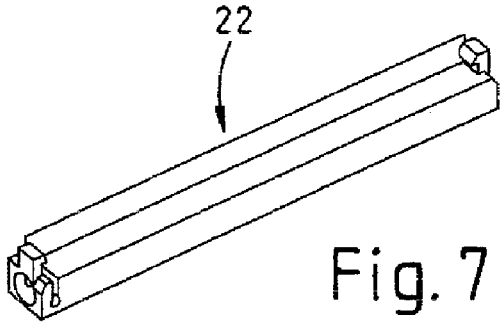
FIGS. 7 to 9 show alternative refinements of that part of a guide device which is shown in FIG. 6.

FIG. 7 shows an alternative refinement of an adaptor element 22, in which, in this case, there is no spring section for length compensation for the adaptor element 22.

Figure 8:
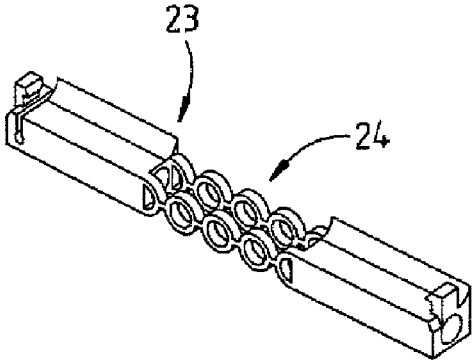
Figure 9:
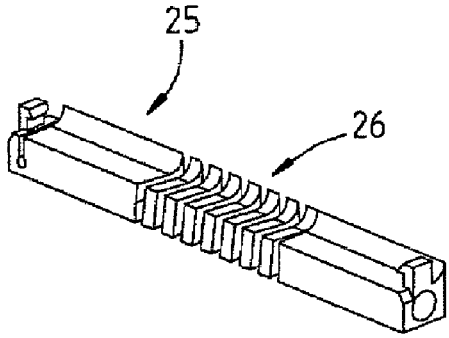

Further alternative adaptor elements 23 and 25, which are of similar design to the adaptor elements 16, 17, are shown in FIGS. 8 and 9. In this case, the adaptor element 23 has a spring section 24, and the adaptor element 25 has a spring section 26. For this purpose, at least in the area of their spring sections 24 and 26, the adaptor elements 16, 17, 23 and 25 are formed in particular with recesses and using an appropriately suitable material, for example being composed of a plastic or a material with elastic characteristics.

In principle, the adaptor elements 16, 17, 22, 23 and 25 may also be attached to the base-rail part 1 in a corresponding manner to that in which the guide profile 2 is fitted.

Figure 10:
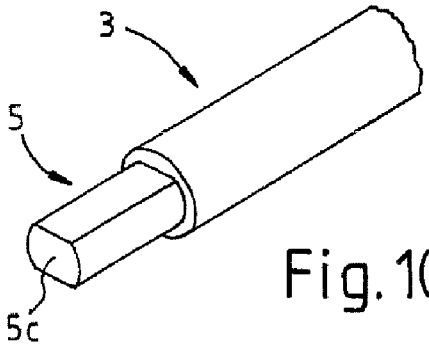
FIG. 10 shows a perspective view of the front end of the pulling-pushing element, as shown in FIGS. 1 to 4.
Figure 14:
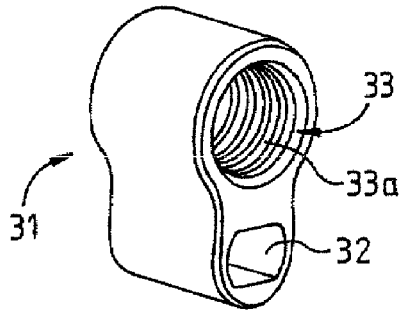
FIG. 14 shows a perspective view of a part of the adjusting part illustrated in FIGS. 11 to 13.
Figure 15:
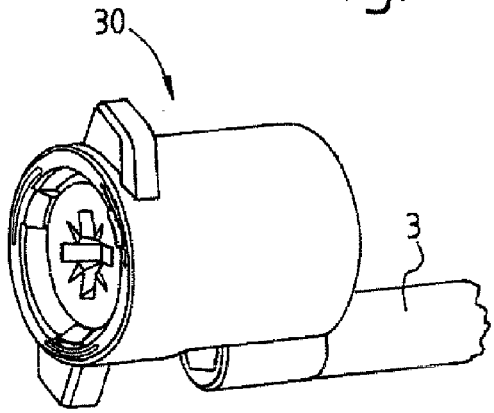
FIG. 15 shows a perspective view of the adjusting part shown in FIGS. 11 to 13, with a pulling-pushing element acting on it.

FIG. 10 illustrates a detail of the front section of the movement rod 3 as shown in FIGS. 1 to 4. In order to fix the movement rod 3 and in order to link it in a simple manner to a drawer rail for its to-and-fro movement, an adjusting member 30 is formed, for example, on the drawer rail, at its front end pointing towards an operating face. The adjusting member 30 comprises an adjusting ring 31 (FIG. 14) which is guided such that it can move thereon and has an insertion opening 32 for the pin 5 of the movement rod 3. The wall of the insertion opening 32 is matched to the external contour of the pin 5 such that the pin 5 can engage in the insertion opening 32 with little play. This can be seen in particular from FIG. 15, which shows the adjusting member 30 with a movement rod 3 inserted in it. FIG. 15 does not show the necessary fixing or attachment for the movement rod 3 to the adjusting member 30. This could, for example, be provided by a fixing screw (not illustrated), which is screwed in on one end surface 5*c* of the pin 5 and which prevents the movement rod 3 from being pulled out of the adjusting ring 31. The pin 5 can also be pressed, welded, adhesively bonded, crimped, pinned or fixed in a manner such as this in the insertion opening 32.

The adjusting ring 31 also comprises a hole 33 with an internal thread 33*a*. The internal thread 33*a* allows the adjusting ring 31 to be moved in the adjusting member 30, and in particular to be moved forwards and backwards, by means of an adjusting screw 34 which is likewise part of the adjusting member 30. For this purpose, the adjusting ring 31 is held, such that it can move, in an adjusting sleeve 35 of the adjusting member. The adjusting screw 34 can likewise be rotated in the adjusting sleeve 35, but is held firmly fixed in its longitudinal direction. This can be achieved, for example, by means of contact tabs 36 and a contact section 37 in an aperture opening 38 in the adjusting sleeve 35. In order to achieve a cleanly guided shifting movement of the adjusting ring 31 by rotation of the adjusting screw 34, the adjusting ring 31 is guided with its outside on profiled guide sections of the aperture hole 38. For this purpose, by way of example, guide webs 39 and guide surfaces 40 which run in the aperture opening 38 are formed along the aperture opening 38.

Figure 11:
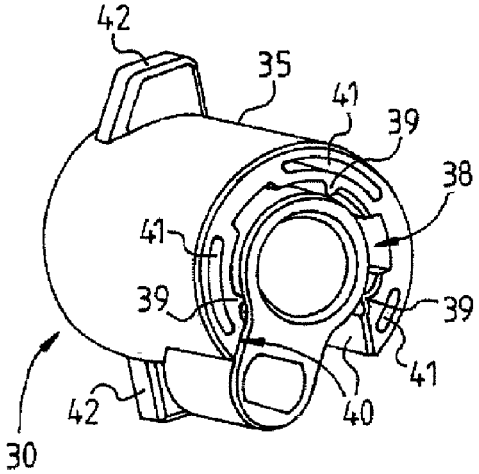
FIGS. 11 and 12 show an adjusting part in the form of a perspective view obliquely from behind and obliquely from in front.
Figure 12:
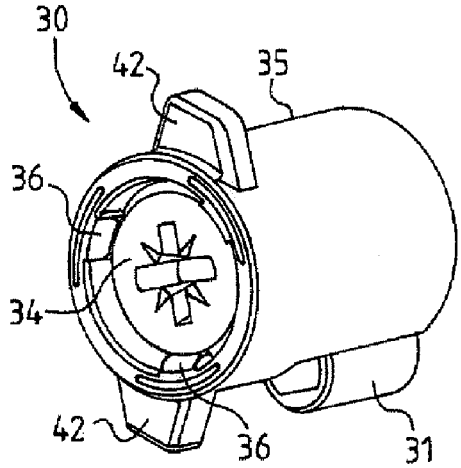
Figure 13:
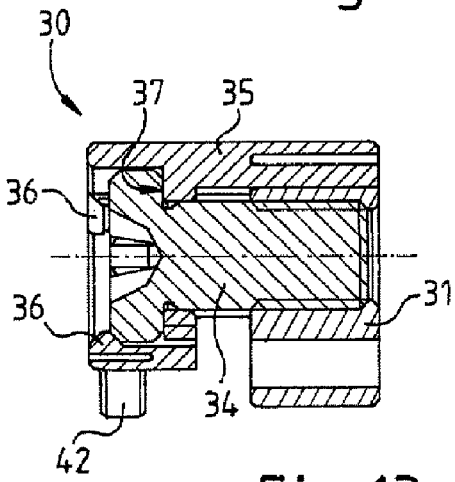
FIG. 13 shows a longitudinal section of the adjusting part shown in FIGS. 11 and 12.

As can be seen in particular from FIG. 11, the adjusting ring 31 can be pivoted about its longitudinal axis over a certain angle range as required in the aperture opening 38, for example over an angle range of about 30 degrees of angle. If appropriate, this makes it possible to compensate for any minor position compensation movements which may occur between the movement rod 3 and the drawer rail, in particular when the majority of the movement rod 3 has been moved out of the elongated hole 4 in the guide profile 2 when the drawer is pulled partially or entirely out (with reference to FIGS. 1 to 4).

Figure 16:
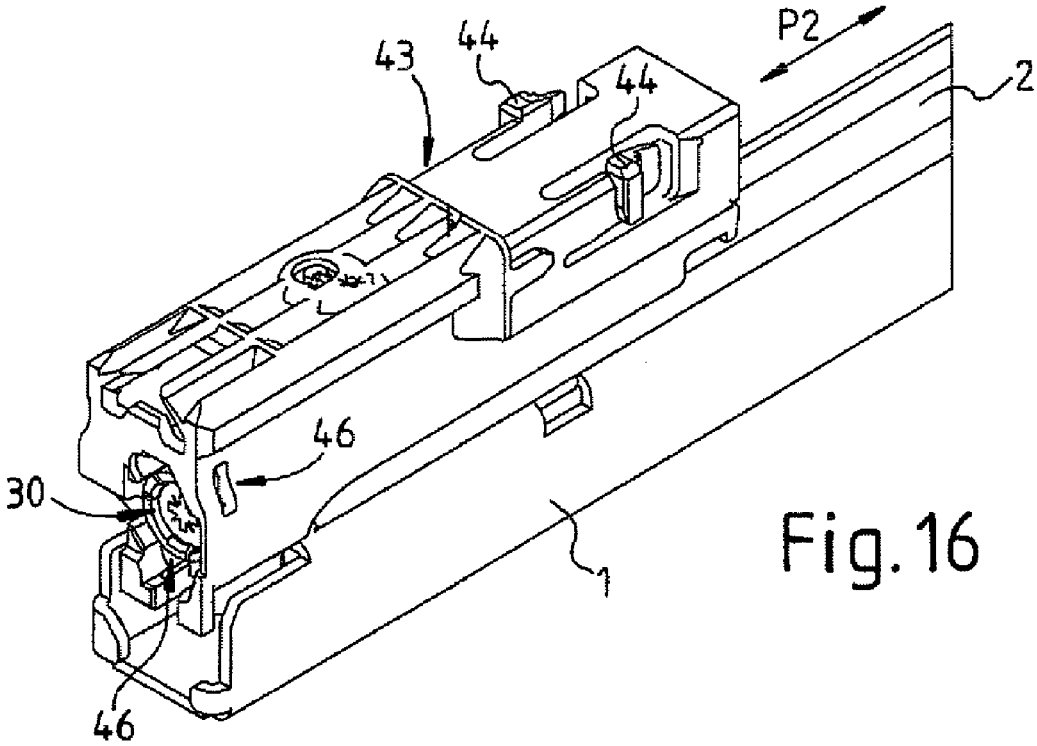
FIG. 16 shows a perspective view of the front part of the arrangement shown in FIG. 1 and FIG. 2 with a fitting element fitted to it, in which an adjusting part as shown in FIGS. 11 to 13 is positioned.
Figure 18:
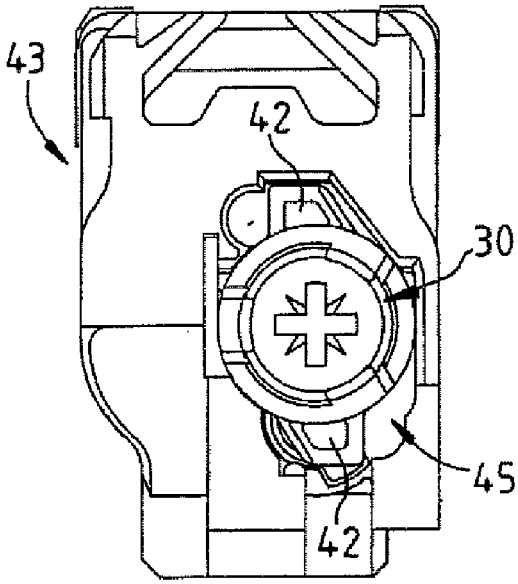
FIG. 18 shows the fitting element as shown in FIG. 16, with an adjusting part plugged in but not fixed.

The adjusting sleeve 35 may approximately assume a cylindrical external shape and, for example, for material saving reasons and/or in order to reduce weight, may be provided with cavities 41. In order to allow simple replacement and for detachable fixing of the adjusting member 30 on the drawer rail, a fitting element 43 may, for example, be provided preferably at the front end of the drawer rail (see FIGS. 16, 18 and 19). The fitting element 43 illustrated in FIG. 16 is shown in its installed position on the drawer rail with the drawer rail moved back and with the drawer in the closed state which is correspondingly reached in this way. The drawer rail itself is not illustrated, but, for example, is formed from profiled sheet-metal material, particularly in a manner corresponding to known drawer rails. The fitting element 43 can be fixed to the drawer rail preferably via sprung latching jaws 44 which can latch detachably into corresponding mating sections on the drawer rail. As illustrated by the arrow P2 in FIG. 16, the fitting element 43 can be moved together with the drawer rail, which is not illustrated, with respect to the stationary base-rail part 1 and the guide profile 2 which is attached to it. This to-and-fro movement is carried out by the driven movement of the drawer rail and thus of the drawer by means of the movement rod 3 of the pulling-pushing element. The to-and-fro movement of the pulling-pushing element is provided by a drive unit, which is not illustrated. As described above, the movement rod 3 is connected to the fitting element 43 via the adjusting member 30 which is fixed in the fitting element 43 (see FIG. 16).

The movement capability for the drawer rail and if required a center rail with respect to the housing rail and/or the base-rail part 1 can be provided in particular by means of an arrangement which is known per se, for example by means of a roller carriage with bearing bodies.

Figure 17:
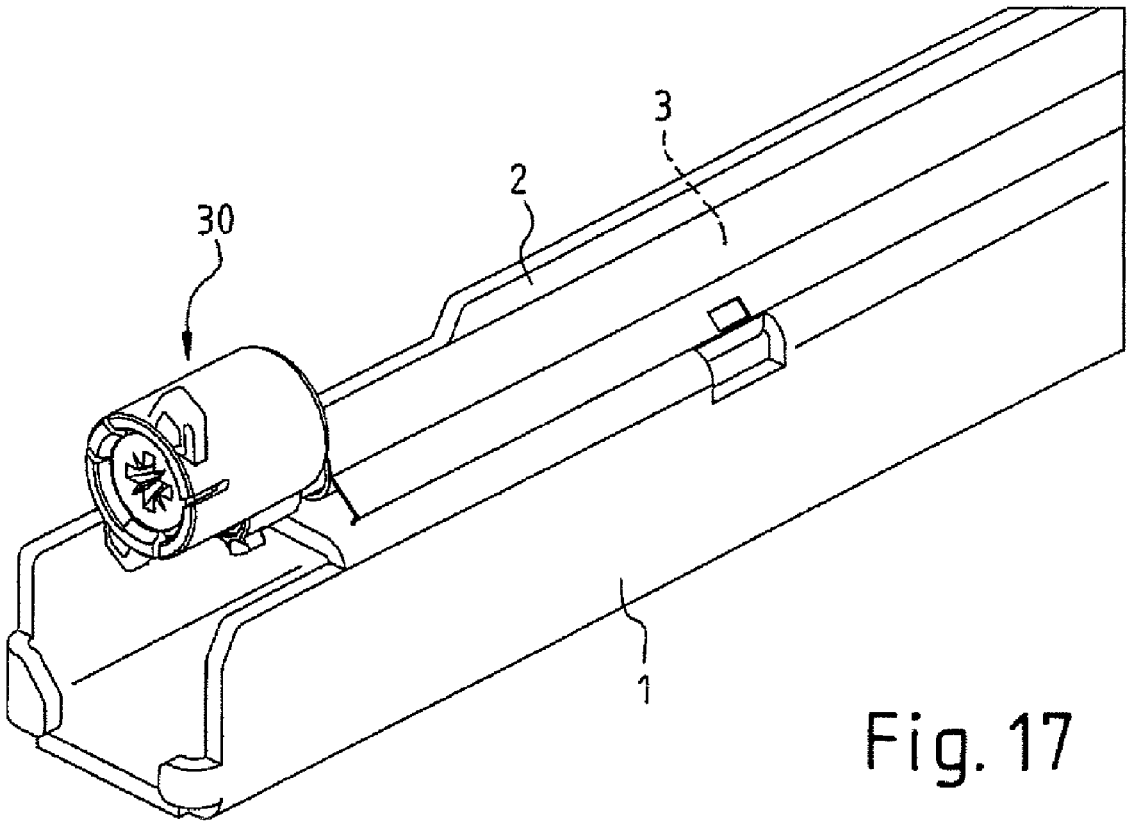
FIG. 17 shows the arrangement as shown in FIG. 16, but with the fitting element omitted.

In order to provide a better illustration of the coupling of the pulling-pushing element and of the movement rod 3 to the drawer rail and to the adjusting member 30, respectively, FIG. 17 shows only the base-rail part 1 with the guide profile 2 fitted to it, and the movement rod 3 accommodated therein, as well as the adjusting member 30, which is firmly fitted to the movement rod 3.

Figure 19:
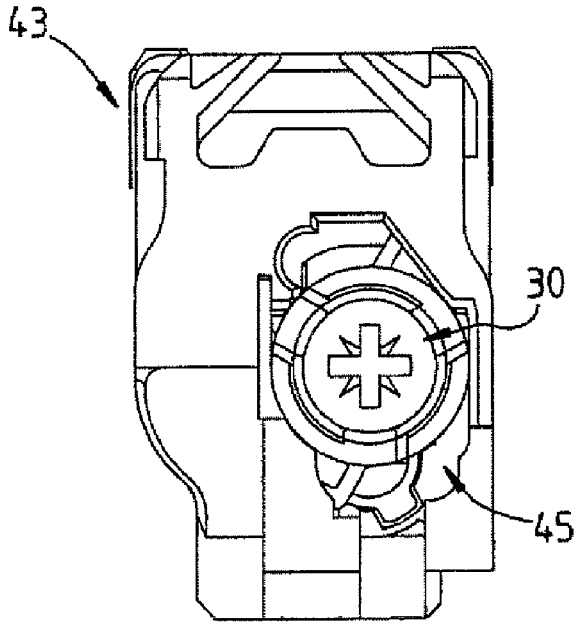
FIG. 19 shows the arrangement as shown in FIG. 18 with an adjusting part, fixed by rotation, in the fitting element.

In order to fit the adjusting member 30 to the fitting element 43, and to remove it, two latching vanes 42, which are opposite one another with respect to the longitudinal axis of the adjusting member 30, are integrally formed on a cylindrical outer face of the adjusting sleeve 35. In addition, an installation opening 45 is provided from the front or the installation side on the fitting element 43, in which installation opening 45 the adjusting member 30 can be inserted such that it fits, in which case the latching vanes 42 can be inserted into the installation opening 45 only when the adjusting member is in the installed position, for example when the adjusting member 30 is in a position in which the latching vanes 42 are positioned approximately vertically one above the other, as can clearly be seen in particular in FIG. 18. The adjusting member 30, which is inserted into the fitting element 43 in this position, can be pushed in as far as a stop, which is not illustrated in any more detail, in the installation opening 45 and can be moved to a latching position in the fitting element 43 in this stop position by rotation of the adjusting member 30 or of the adjusting sleeve 35, as is illustrated in FIG. 19. By way of example, in this latching position, the latching vanes 42 are each held firmly, clamped in place, in a cut-out gap 46 in the fitting element 43 (see FIG. 16).

Figure 20:
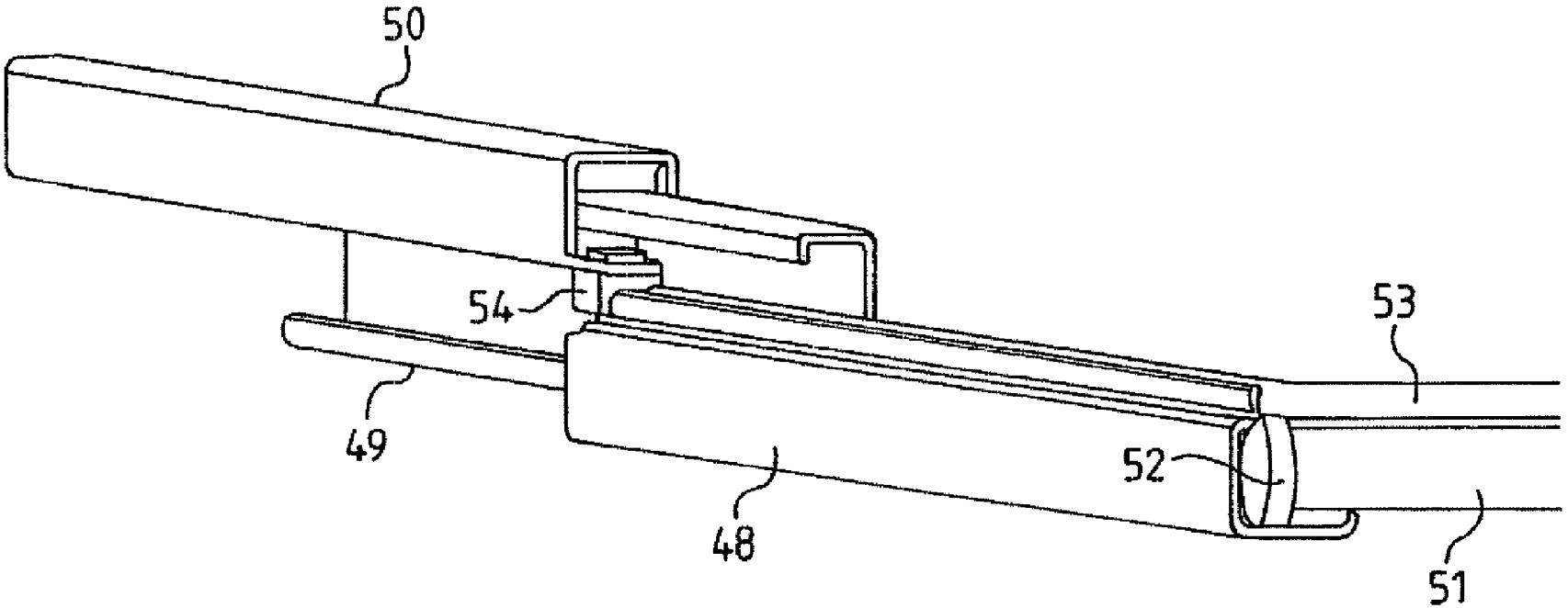
FIG. 20 shows a perspective partial view of a drawer guide of an alternative refinement of the device according to the invention for influencing the movement.
Figure 21:
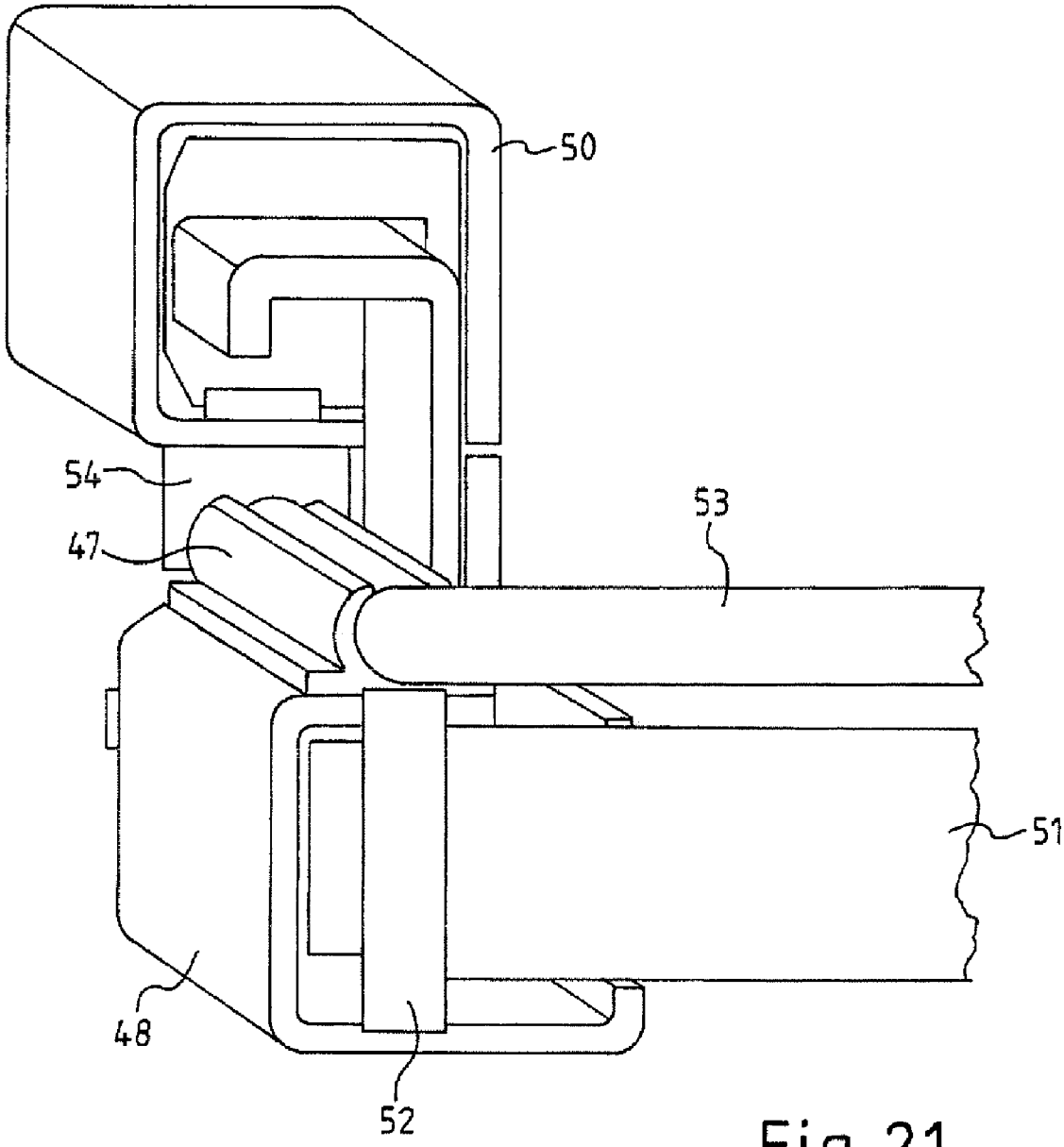
FIG. 21 shows a further perspective view of the arrangement shown in FIG. 20, in the form of a perspective view obliquely from the rear.

FIGS. 20 and 21 show side perspective views of a part of a drawer guide according to the invention with a guide profile 47 which is plugged onto a base-rail part 48 of a housing rail. The drawer guide also includes a center rail 49 and a drawer rail 50. In addition, a drive shaft 51 with a toothed wheel 52 is illustrated schematically, by which means, when the toothed wheel 52 makes contact, forming an engagement, with a rising cable 53, this can be moved backwards and forwards, in a driven manner, in the guide profile 47. In order to transmit the shift movement via the rising cable 53 from a drive unit, which is not shown, a driver 54 is fitted to the drawer rail 50, mounted at its rear end. The driver 54 is connected to the rising cable 53 such that, during a shifting movement of the rising cable 53 in the guide profile 47, the driver 54 and thus the drawer rail 50 can be moved past on the guide profile 47.

Figure 22:
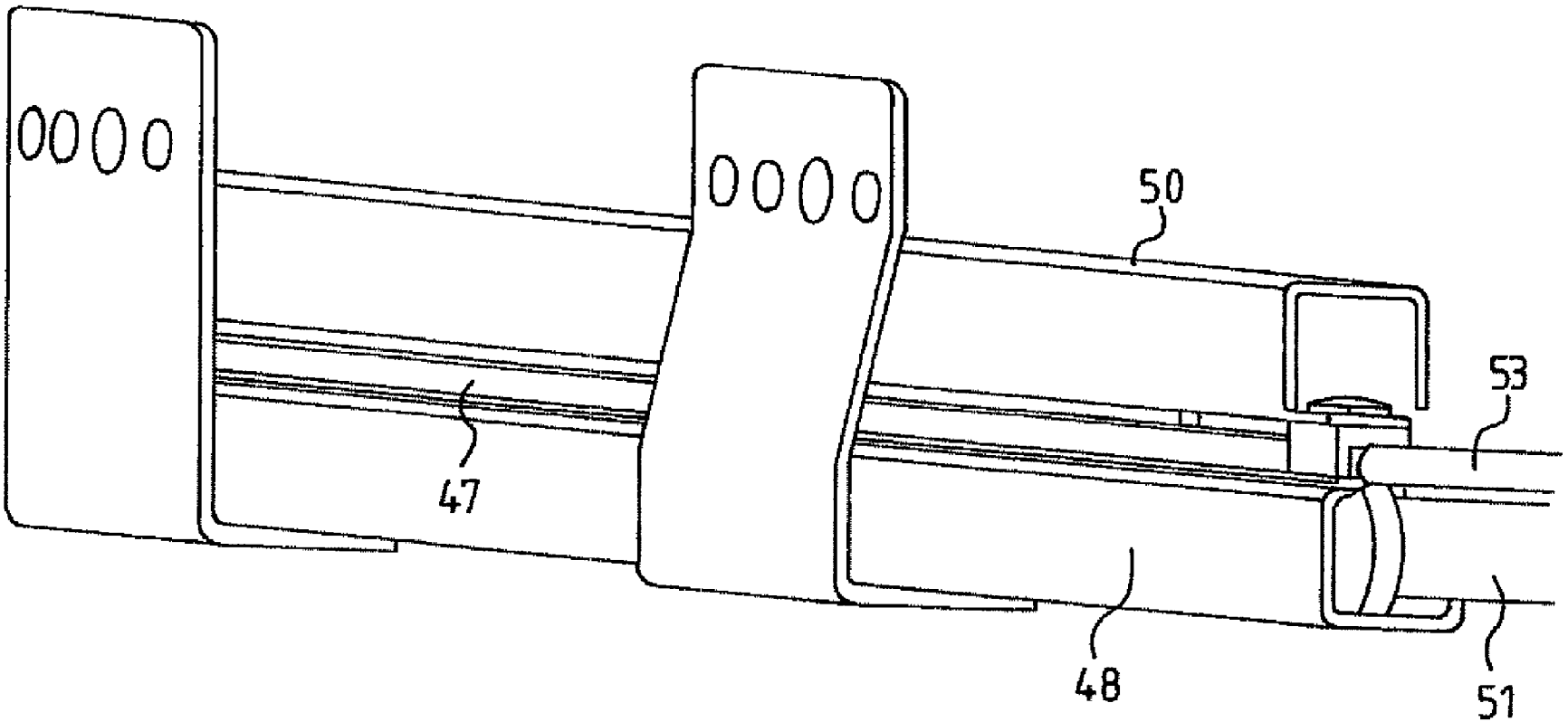
FIG. 22 shows a further perspective partial view of the drawer guide as shown in FIGS. 20 and 21, in the drawn-in state, with holding jaws being shown on a housing rail.

The position of the drawer rail 50 when the drawer is in the completely moved-back position or in the closed position, with the drawer being attached to the drawer rail 50 (not illustrated), is shown in FIG. 22. In this case, the driver 54 at the rear end of the guide profile 47 has been moved back away from the position illustrated in FIG. 20.

Figure 23:
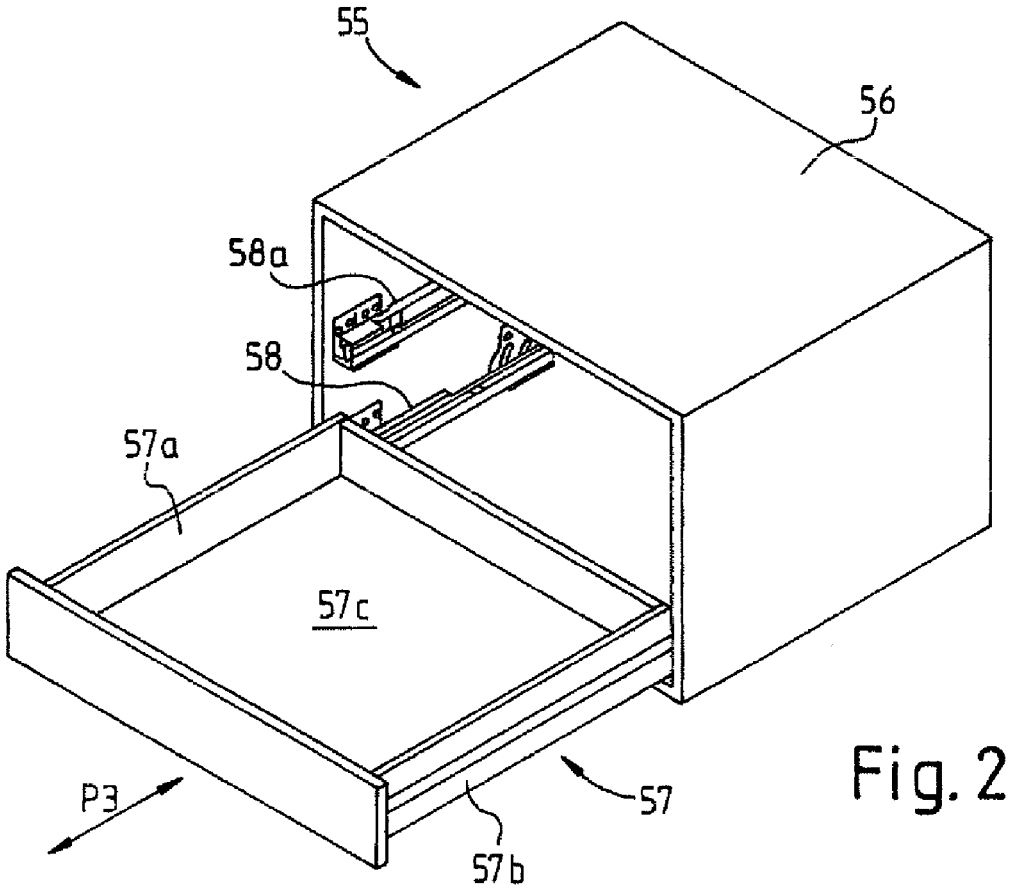
FIG. 23 shows a piece of furniture with a drawer which is held in a housing with a device according to the invention.

FIG. 23 shows, obliquely from above, a piece of furniture 55 according to the invention, which comprises a housing 56 and a drawer 57 which is guided such that it can move therein. The drawer 57, which is arranged in the lower area of the housing 56, is illustrated in the open or pulled-out state, with the furniture parts 56, 57 which can be moved with respect to one another being movable with respect to one another via a pulling-out fitting or a drawer guide 58. A further drawer, which is not illustrated, can be accommodated in the same way in the housing 56 via a further drawer guide 58*a*. The drawer 57 can be pulled out or pushed in relative to the housing 56, as indicated by the double-headed arrow P3. In order to hold and/or guide the movement of the drawer 57, an identical drawer guide 58 is in each case accommodated in the lower area of drawer frames 57*a*, which project upwards on both sides on a drawer bottom 57*c*, with the drawer guide 58 or 58*a* being illustrated in FIG. 1 only on one inner face of the housing, in each case. The drawer 57 can be driven, in which case, for example, the drive unit can be arranged in the rear area of the housing and/or of the guide 58 (although this cannot be seen here).

Figure 24A:
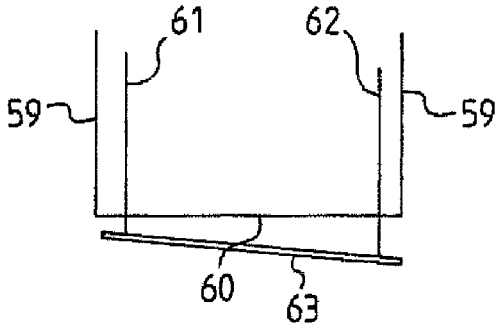
FIGS. 24*a* and 24*b* show a highly simplified outline sketch of a horizontal section through a drawer, which is held in a housing as shown in FIG. 20, with an installation position error of a guide unit, and in an installed state which has been corrected according to the invention with respect to this.
Figure 24B:
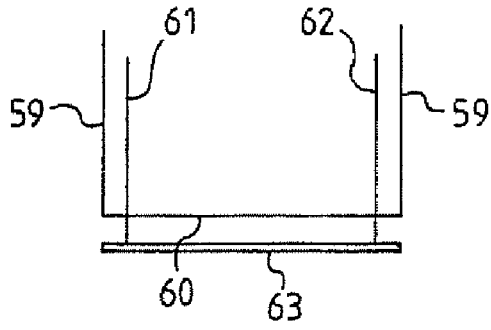

FIG. 24*a* shows a view, in the form of a sketch, of a piece of furniture as shown in FIG. 23, from above. In this case, side walls 59 and a front edge 60 of a furniture housing and right-hand and left-hand drawer guides 61, 62, which are mounted on the side walls 59, are installed. The drawer guides 61, 62 as shown in FIG. 24*a* are illustrated in an exaggerated form, installed differently in the depth of the side walls 59, as can occur, for example, if installed inaccurately. As a result of the discrepancy in the exact alignment of the installed position of the two drawer guides 61, 62 in depth relative to the front edge 60, a drawer front 63 of a drawer which is attached to the drawer guides 61, 62 is positioned obliquely with respect to the front edge 60. The right-hand and left-hand drawer guides 61, 62 can each be adjusted independently of one another by means of the depth adjustment of the drawer guides 61, 62 according to the invention from the inclined front position of the drawer front 63 with respect to the housing, as shown in FIG. 24*a*. The depth adjustment is carried out by adjustment of the pulling-pushing element, which acts on drawer rails of the drawer guides 61, 62. The drawer front 63 can thus be aligned parallel to the front edge 60 as shown in FIG. 24*b*. By way of example, in the case of the drawer guide 61 which is illustrated in FIG. 24*a*, the point at which the pulling-pushing element acts on the drawer rail can be enlarged in the longitudinal direction of the drawer guide 61. On the other hand, the point at which the pulling-pushing element acts on the drawer rail of the drawer guide 62 can be reduced along the drawer guide 62.

LIST OF REFERENCE SYMBOLS

| | |
|---|---|
| 1 | Base-rail part |
| 2 | Guide profile |
| 3 | Movement rod |
| 4 | Elongated hole |
| 5 | Pin |
| 5a | Outer surface |
| 5b | Outer surface |
| 5c | End surface |
| 6 | Sheet-metal lug |
| 7 | Groove |
| 8 | Cavity |
| 9 | Cavity |
| 10 | Cavity |
| 10a | Slot |
| 11 | Guide profile |
| 12 | Housing rail |
| 12a | Fitting jaw |
| 12b | Fitting jaw |
| 13 | Guide profile |
| 14 | Base-rail part |
| 15 | Guide tube |
| 16 | Adaptor element |
| 17 | Adaptor element |
| 18 | Latching tab |
| 19 | Guide channel |
| 20 | Spring section |
| 21 | Contact edge |
| 22 | Adaptor element |
| 23 | Adaptor element |
| 24 | Spring section |
| 25 | Adaptor element |
| 26 | Spring section |
| 27 | Unused |
| 28 | Unused |
| 29 | Unused |
| 30 | Adjusting member |
| 31 | Adjusting ring |
| 32 | Insertion opening |
| 33 | Hole |
| 33a | Internal thread |
| 34 | Adjusting screw |
| 35 | Adjusting sleeve |
| 36 | Contact tab |
| 37 | Contact section |
| 38 | Aperture opening |
| 39 | Guide web |
| 40 | Guide surface |
| 41 | Cavity |
| 42 | Latching vane |
| 43 | Fitting element |
| 44 | Latching jaw |
| 45 | Installation opening |
| 46 | Holding gap |
| 47 | Guide profile |
| 48 | Base-rail part |
| 49 | Center rail |
| 50 | Drawer rail |
| 51 | Driveshaft |
| 52 | Toothed wheel |
| 53 | Rising cable |
| 54 | Driver |
| 55 | Piece of furniture |
| 56 | Housing |
| 57 | Drawer |
| 57a | Drawer frame |
| 57b | Drawer frame |
| 57c | Drawer bottom |
| 58 | Drawer guide |
| 58a | Drawer guide |
| 59 | Side wall |
| 60 | Front edge |

-continued

| | |
|---|---|
| 61 | Drawer guide |
| 62 | Drawer guide |
| 63 | Drawer front |

We claim:

1. A device for influencing the movement of furniture parts which move with respect to one another, comprising a guide unit for guidance of a first furniture part on a second furniture part, a drive unit to move the first furniture part in a driven manner relative to the second furniture part, the guide unit having a fixed rail, which is associated with the second furniture part, and a moving rail, which is associated with the first furniture part, wherein adjusting means is provided for adjustment of the position of a position member on the moving rail, and a pulling-pushing element acts on the position member to move the first furniture part relative to the second furniture part in a first direction and a second direction opposite the first direction.

2. The device as claimed in claim 1, wherein the pulling-pushing element applies a drive effect from the drive unit to the first furniture part, and is guided on the fixed rail by a guide rail profile.

3. The device as claimed in claim 2, wherein the guide means for guidance of the pulling-pushing element comprises a part that is detachably fitted to the fixed rail.

4. The device as claimed in claim 3, wherein the part that is detachably fitted to the fixed rail has holding areas for line means.

5. The device as claimed in claim 2, wherein the guide means comprises a slotted guide profile.

6. The device as claimed in claim 1, wherein the adjusting means is positioned so that the guide unit is adjustable when the guide unit is mounted on the furniture parts.

7. The device as claimed in claim 1, wherein the adjusting means provides continuously variable adjustment of the position member.

8. The device as claimed in claim 1, wherein the adjusting means is formed on an end section, viewed in the longitudinal direction, of the moving rail.

9. The device as claimed in claim 1, wherein the position member comprises an adjusting slide that is movably held on a guide part.

10. The device as claimed in claim 9, wherein the guide part is fitted to the moving rail via detachable securing means.

11. The device as claimed in claim 9, wherein the adjusting slide has a threaded section with which a matching opposing thread on a control part interacts to adjust the position of the adjusting slide.

12. The device as claimed in claim 1, wherein the adjusting means is fitted as a separate unit to the moving rail.

13. A piece of furniture comprising the device as claimed in claim 1.

14. The device of claim 1, wherein the position member is fixedly attached to the pulling-pushing element.

15. A device for influencing the movement of furniture parts which moves with respect to one another, comprising a guide unit for guidance of a first furniture part on a second furniture part, the guide unit enabling the first furniture part to move relative to the second furniture part, the guide unit having a fixed rail, which is associated with the second furniture part, and a moving rail, which is associated with the first furniture part, wherein the device further comprises a part which can be detachably fitted to the fixed rail to accommodate line means and a pushing-pulling element acts on the position member to move the first furniture part relative to the second furniture part in a first direction and a second direction opposite to the first direction.

16. The device of claim 15, wherein the position member is fixedly attached to the pulling-pushing element.

* * * * *